US006434778B1

(12) United States Patent
Edwards et al.

(10) Patent No.: US 6,434,778 B1
(45) Date of Patent: Aug. 20, 2002

(54) MONOFILAMENT BRISTLE ASSEMBLIES AND METHODS OF MAKING BRUSHES USING SAME

(75) Inventors: Mark Stephen Edwards; Jeffrey Allen Chambers, both of Hockessin; Wayne Hugh Marshall, Wilmington; Roberto Bucker, Hockessin; James Harmon Watts, Wilmington, all of DE (US); Susan Elaine Loudin, Landenberg, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/723,698

(22) Filed: Nov. 28, 2000

Related U.S. Application Data

(62) Division of application No. 09/092,094, filed on Jun. 5, 1998.

(51) Int. Cl.[7] ..... A46B 9/04; A46B 9/02

(52) U.S. Cl. ..... 15/159.1; 15/206

(58) Field of Search ..... 15/159.1, 167.1, 15/179, 182, 194, 195, 204, 205, 206; 300/21; 428/93–95

(56) References Cited

U.S. PATENT DOCUMENTS

| | | | | |
|---|---|---|---|---|
| 1,296,067 A | | 3/1919 | Fuller | |
| 1,684,855 A | | 9/1928 | Acheson | |
| 2,475,019 A | | 7/1949 | Faris | |
| 2,599,191 A | | 6/1952 | Meunier | |
| 2,786,508 A | | 3/1957 | Waage | |
| 2,812,214 A | * | 11/1957 | Sandelin | 15/182 |
| 2,980,467 A | | 4/1961 | Lechene | |
| 3,216,038 A | * | 11/1965 | Gould et al. | 15/182 |
| 3,263,258 A | * | 8/1966 | Burge | 16/167.1 |
| 3,618,154 A | | 11/1971 | Muhler et al. | |
| 3,798,699 A | | 3/1974 | Lewis, Jr. | |
| 4,030,845 A | * | 6/1977 | Deckert | 15/167.1 |
| 4,148,953 A | | 4/1979 | Horton | |
| 4,211,217 A | | 7/1980 | Gueret | |
| 4,325,900 A | | 4/1982 | Holding et al. | |
| 4,325,902 A | | 4/1982 | Holding | |
| 4,406,032 A | | 9/1983 | Diamant | |
| 4,423,532 A | | 1/1984 | Yagi et al. | |
| 4,438,541 A | | 3/1984 | Jacob et al. | |
| 4,493,125 A | | 1/1985 | Collis | |
| 4,507,361 A | * | 3/1985 | Twilley et al. | 15/207.2 |
| 5,459,898 A | * | 10/1995 | Bacolot | 15/195 |
| 5,470,629 A | * | 11/1995 | Mokhtar et al. | 428/95 |
| 5,472,762 A | * | 12/1995 | Edwards et al. | 428/95 |
| 5,547,732 A | | 8/1996 | Edwards et al. | |
| 5,682,911 A | | 11/1997 | Harada | |
| 5,804,008 A | | 9/1998 | Kennard et al. | |
| 5,967,617 A | * | 10/1999 | Zapanta | 300/21 |
| 6,041,463 A | * | 3/2000 | Stauch | |

FOREIGN PATENT DOCUMENTS

| | | | | |
|---|---|---|---|---|
| DE | 4114136 | | 11/1992 | |
| DE | 19536775 | | 4/1997 | |
| DE | 19604559 | | 8/1997 | |
| FR | 2541100 A | | 8/1984 | |
| GB | 1457074 | | 12/1976 | |
| JP | 12-36008 A | | 9/1989 | |
| JP | 6-154030 | * | 6/1994 | 15/167.1 |
| WO | WO 97/14830 | | 4/1997 | |
| WO | WO 97/39651 | | 10/1997 | |
| WO | WO 98/25500 | | 6/1998 | |
| WO | WO 99/42019 | | 8/1999 | |

* cited by examiner

*Primary Examiner*—Terrence R. Till

(57) ABSTRACT

Several brush assemblies are disclosed. All employ bristle strings that include a base string connected to a plurality of monofilaments. The preferred monofilaments are nylons and other polymeric thermoplastic materials. The monofilaments may be linear segments or loop segments disposed in two rows. The bristle strings may be connected to brush bodies to form virtually any of the various types of brushes. Bristle strings employing loops may be braided together to form entangled, monofilament articles for brush or other applications.

9 Claims, 10 Drawing Sheets

MONOFILAMENT BRISTLE ASSEMBLIES AND METHODS OF MAKING BRUSHES USING SAME

This is a continuation-in-part, division of Application Ser. No. 09/092,094 filed Jun. 5, 1998.

BACKGROUND OF THE INVENTION

The present invention relates generally to brushes and the art of brush making, and more particularly, to brushes having monofilament bristles and methods of assembling monofilament bristle sub-assemblies to brush bodies.

Brush making involves the attachment of bristles to a brush body. In one type of brush, known as the "solid block/staple set," a solid block acting as the brush body is drilled, molded, or otherwise worked to form an array of holes. Individual tufts are placed in individual holes and secured to the block by wire staples, plugs or other anchoring means. Hand drawn brushes are similar except that the tufts are secured by drawing them through the holes with an elongated strand.

Another type of brush employs a "ferrule and monofilaments" technique for attaching the bristles to the brush body. A cluster of monofilaments and cavity creating spacers are inserted into a ferrule and set with a binding resin. Ferrule brushes, such as the paint brush, are used to primarily apply liquid or viscous solutions.

In metal strip brushes, fibers are held in a "U" shaped channel of a metal strip by an anchoring wire, string, or monofilament. The channel is then crimped closed to mechanically clamp the proximal end portions of the monofilaments and anchor wire within the strip. Once formed, the brush-strips can be attached to brush bodies or otherwise shaped for specific applications. Fused brushes are those in which polymeric tufts are fused directly to a brush body that is preferably made of the same material. One variation of fused brushes employs ultrasonic welding to secure polymeric fibers directly to a base.

With respect to the toothbrush, it is now commonplace to employ nylon monofilaments that are grouped together to form "bristle tufts." Each bristle tuft is typically arranged in a circular cluster, and a complete bristle head includes a matrix of bristle tufts arranged in rows or other patterns. The folded proximal bases of the bristle tufts are typically embedded and held in place by an anchor wire that extends across the field of the tufts and into the polymeric material that forms the head portion of the toothbrush body, while the distal ends extend upwardly therefrom, often terminating in a common plane. A more recent tufting method employs the process of cutting the tuft of monofilaments to the desired length, heat fusing the proximal ends and embedding the fused proximal ends into the polymeric material of the toothbrush head.

More recent innovations in the toothbrush art have included bristle tufts cut to provide differing lengths to provide an array of shorter and longer tufts to achieve a desired action on the user's teeth. In some tufts the monofilaments are of differing length. While these improvements can result in better functional aspects of the toothbrush, few innovations have been made over the years in techniques for manufacturing the toothbrush head; this is particularly evident in the manner in which bristles are assembled with the brush body.

In all types of known brushes, the assembly process can represent a substantial portion of the cost of manufacture since individual bristle filaments have to be held in a desired grouping and then bound to the brush body in a manner that ensures that the bristle filaments do not become detached during use. Also, recycling becomes more problematic for brushes which employ metal staples or other combinations of different classes of materials (plastics and metals, for example) in one structure.

A continuing need exists for improved brush designs and methods of manufacturing brushes which are efficient and cost effective.

SUMMARY OF THE INVENTION

An object of the present invention is to provide means to expand brush design beyond the range possible with current tufting techniques.

An object of the present invention is to provide means to expand brush design beyond the range possible with current tufting techniques.

Another object of the present invention is to provide a bristle sub-assembly for a brush in which individual filaments are positionally fixed with respect to each other prior to connection to a brush body.

Still another object of the present invention is to provide a method of assembling brushes in which bristle sub-assemblies can be permanently connected to the brush body or, alternatively, detachably connected for subsequent replacement, thereby avoiding wastefully discarding otherwise functional brush bodies.

These and other objects are met by providing a bristle sub-assembly which includes a base string and a plurality of polymeric monofilaments connected transversely to the base string. Each monofilament, when connected to the base string. Each monofilament, when connected to the base string, forms a pair of monofilament segments, and the monofilament segments are disposed in two rows along the base string. The monofilament segments of the two rows extend outwardly from the base string to form a V-shaped bristle string which can be used in a variety of different brush applications.

In an alternative embodiment, the bristle sub-assembly includes a plurality of monofilament loops connected to a base string. Each loop is connected transversely to the base string to form a pair of loop segments extending outwardly from opposite sides of the base string to form two rows of loop segments.

Two or more looped or cut monofilament sub-assemblies can be twisted or braided together to form cylindrical structures having value in many applications, such as brushes.

The bristle sub-assemblies can be attached to brush bodies in a variety of ways to forth unique brush/bristle assemblies.

Other objects and features of the invention will become more apparent from the following detailed description when taken in conjunction with the illustrative embodiments in the accompanying drawings.

DETAILED DESCRIPTION OF THE PREFERRED EMBODIMENTS

Figure 1:
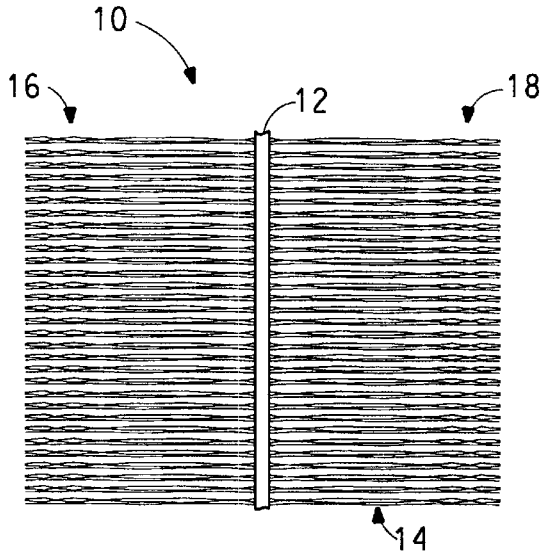
FIG. 1 is a top view of a bristle sub-assembly according to a preferred embodiment of the present invention.
Figure 2:
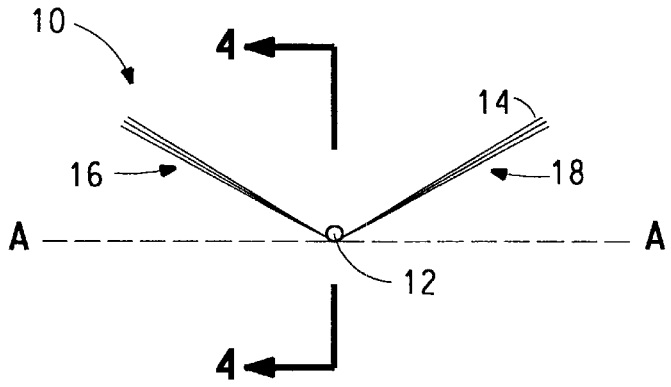
FIG. 2 is a front view of the bristle sub-assembly of the embodiment of FIG. 1.

Referring to FIGS. 1 and 2, a bristle sub-assembly 10 includes a base string 12 and a plurality of monofilaments 14 connected to the base string 12. The monofilaments 14 are preferably connected to the base string 12 substantially perpendicularly, as shown in FIG. 1, with the base string 12 dividing each monofilament 14 into first and second opposite side legs 16, 18 which extend outwardly from the base string 12 in two rows. In the illustrated embodiment the legs 16 and 18 are of substantially equal length. In other embodiments the legs can be made of differing length by displacing the base string 12 laterally to a position offset from the center before bonding the monofilaments to the base string. Also, while the base string 12 is shown to be substantially normal or perpendicular to the monofilaments 14, the monofilaments could be placed at a variety of angles relative to the base string 12, depending on the brush characteristics desired for the finished product.

As seen in FIG. 2, the legs 16 and 18 are acutely angled relative to the horizontal plane A—A to form a V-shaped structure. The polymeric monofilaments 14 are linear and flexible so that when deflected or bent, a spring restoring force is generated to return them to a linear or substantially linear disposition. In a preferred method of making the sub-assembly 10, heat is used to fuse the monofilaments 14 to the base string 12. In order to facilitate this process, either the monofilaments 14 or the base string 12, preferably both, are made of a polymeric thermoplastic material. Also, in every embodiment, the monofilaments 14 are each a single filament, as opposed to a "multi-filament," such as yarn, twine, etc., although the monofilament may be a co-extrusion of one or more polymers to form a coaxial structure.

The monofilaments 14 may be made of several different materials, including aliphatic polyamides, aromatic polyamides, polyesters, polyolefins, styrenes, fluoropolymers, polyvinylchloride (PVC), polyurethane, polyvinylidene chloride, and polystyrene and styrene copolymers. A particularly suitable polymeric material for toothbrush applications is 6,12 nylon; other nylons may be used, including 4 nylon, 6 nylon, 11 nylon, 12 nylon, 6,6 nylon, 6,10 nylon, 6,14 nylon, 10,10 nylon and 12,12 nylon and other nylon co-polymers.

Figure 3:
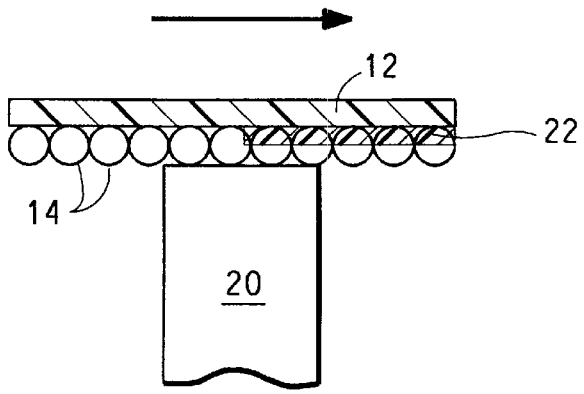
FIG. 3 is a side view of the base string and monofilaments of the bristle sub-assembly of FIG. 1 and an ultrasonic horn for heat fusing.
Figure 4:
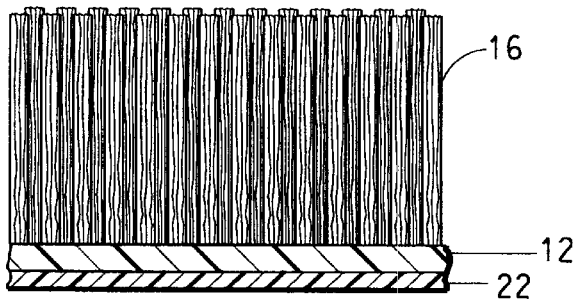
FIG. 4 is an enlarged cross-sectional view taken along line 4—4 of FIG. 2.
Figure 5:
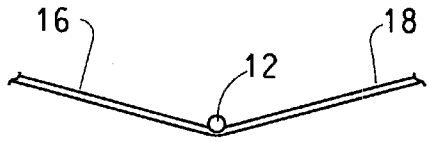
FIG. 5 is an enlarged, partial end view of the bristle sub-assembly of FIG. 1.
Figure 6:
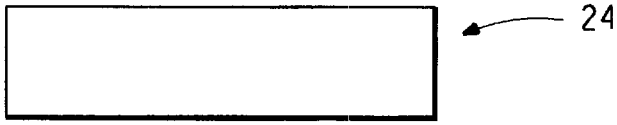
FIGS. 6–10 are sequential, schematic views showing a method of making a rush incorporating a plurality of the bristle sub-assemblies of FIG. 1.
Figure 7:
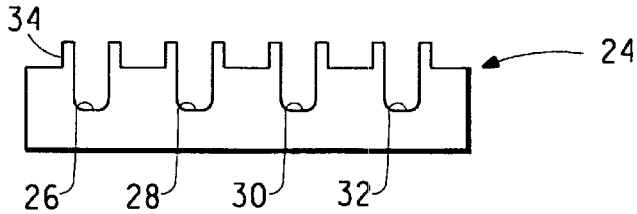

During manufacture of the bristle sub-assembly, and referring to FIGS. 3–5, the monofilaments 14 are arranged substantially parallel to each other in substantially the same plane and placed in contact with the base string 12. In an automated assembly process, the monofilaments 14 and base string 12, positionally fixed with respect to each other, but not yet bonded together, are transported under a stationary ultrasonic horn 20, as indicated by the directional arrow in FIG. 3. The horn 20, which contacts the monofilaments 14, delivers energy sufficient to cause either the monofilament material 14,8 or the base string 12, preferably both, to flow.

In one embodiment, the flow of monofilament material causes adjacent monofilaments 14 to become interconnected through a flow zone 22. This is preferred when the monofilaments are placed shoulder-to-shoulder with adjacent monofilaments abutting each other. In order to facilitate this process either the monofilaments 14 or the base string 12, preferably both, are made of a polymeric thermoplastic material. In the flow zone 22, preferably material from the base string 12 also flows during heating by the ultrasonic horn so that material from the base string inter-mixes with material from the monofilaments. This inter-mixing causes the monofilaments 14 to become interconnected to the base string along the flow zone 22 with interfaces between the base string 12, the flow zone 22, and monofilaments 14. Bonding may also occur by other means and with differing degrees of melt, where for example, the monofilaments are bonded to the base string by encapsulation or simple mechanical interlocking to the base string.

When the monofilaments are shoulder-to-shoulder as in FIG. 3, the interconnection of adjacent monofilaments 14 to each other in flow zone 22 may be relatively strong compared to the interconnection of the base string 12 to the flow zone 22 which is substantially composed of monofilament material. This feature allows, in some applications, the removal of the base string 12 from the monofilaments 14 anytime after thermal fusing. Alternatively, the adhesion between the monofilaments and the base string can be at least as strong as the adhesion between mono filaments.

While FIG. 3 shows the monofilaments in a single row, shoulder-to-shoulder, the density can be varied such that the adjacent monofilaments do not touch each other. Also, the density may be such that a second or greater number of rows of monofilaments are stacked upon each other. Where eight (8) mil nylon monofilament is used, for example, a density of about 125 monofilaments per inch of base string can be achieved with a single row, shoulder-to-shoulder monofilaments.

A method of making a brush using the bristle sub-assemblies described above is illustrated in FIGS. 6–10. First, a brush head blank 24 made of thermoplastic polymeric material is provided in a general size and shape suitable for any one of numerous particular brush applications. In the next step, the blank 24 is thermally processed to form a plurality of grooves 26, 28, 30, and 32. Displaced polymeric material forms ridges that extend above the plane encompassing the upper surface of the blank 24. The grooves can be formed with a heated male forming die. Alternatively, the grooves can be molded into the blank 24 during formation of the blank 24.

The number of grooves, their length, depth and orientation with respect to each other, depends on the size, type and function of the brush. The four (4) grooves shown are illustrative and do not have limiting significance. Also, while the grooves shown in the figures are "U-shaped," they could easily adopt other shapes depending on the shape of the mold or male die, including rectangular.

Figure 8:
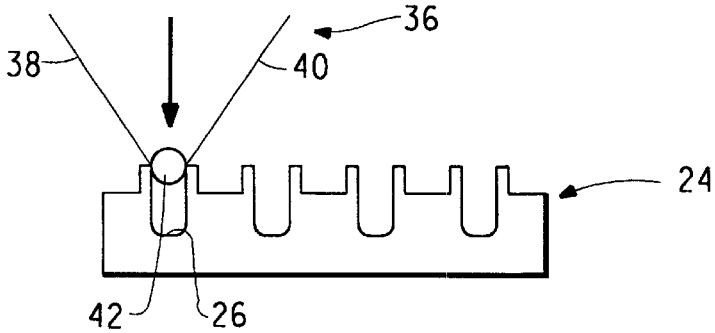
Figure 9:
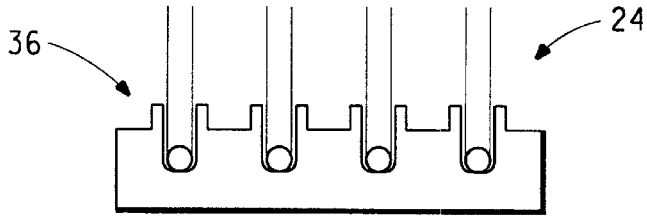
Figure 10:
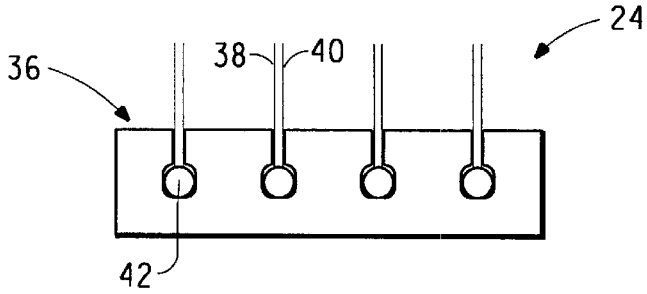
Figure 11:
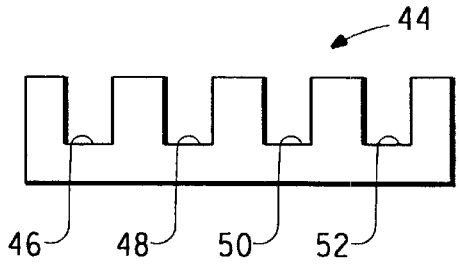
FIGS. 11–14 are sequential, schematic views showing an alternative method of making a brush incorporating a plurality of the bristle sub-assemblies of FIG. 1.

As shown in FIG. 8, a bristle sub-assembly 36 is forced into the groove 26, forcing the legs 38 and 40 into a substantially vertical position, as seen in FIG. 9. The base string 42 preferably seats in the bottom of the groove 26. Preferably, all bristle sub-assemblies, corresponding to the four grooves 26, 28, 30, and 32 are forced into position simultaneously. The four bristle sub-assemblies are locked into position by heat forming the upper surface of the blank 24, thus closing the grooves and forming the structure shown in FIG. 10. Once closed, the base string 42 helps anchor the bristle sub-assembly in its respective groove.

Once the monofilaments are forced into a vertical orientation, with the legs 38 and 40 substantially parallel to each other, the bristle sub-assembly 36 becomes a "bristle string" in that the monofilaments from the two legs tend to commingle and form a "bristle" row.

As seen in FIGS. 11–14, a brush blank 44 is processed to form a plurality of grooves 46, 48, 50, and 52. Groove formation can result from any known techniques, depending on the type of material which comprises the blank 44. For blanks made of thermoplastic polymeric material, formation can be accomplished by molding, thermal displacement or mechanical removal of material. In the case of thermal displacement, accumulation slots may be needed within the brush body to accumulate displaced thermoplastic material. Other blank materials could be employed, including wood and metal. Also, while the base string is shown to have a rectangular shape which fits into similarly shaped rectangular grooves, grooves and base strings of other shapes can be employed. Exact coincidence between the shape of the grooves and the base strings is not necessary.

Figure 12:
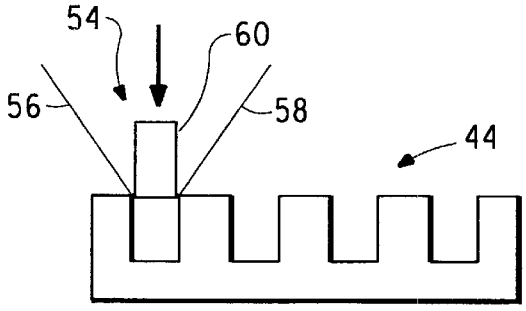
Figure 13:
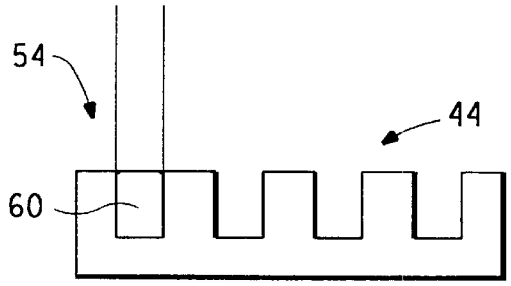

As seen in FIG. 12, the bristle sub-assembly 54 includes first and second monofilament legs 56 and 58 connected to a rectangular-shaped base string 60. Preferably, all four bristle sub-assemblies are fitted into respective grooves in a single motion. When fitted in the grooves, the legs adopt a substantially vertical orientation as shown in FIG. 13. Each vertical pair of legs of each base string defines a bristle string.

Preferably, the grooves have a lesser width than the respective bristle sub-assemblies to ensure a tight, interference fit. If desired, either the bottom portion of the bristle sub-assembly or the surface of the groove, or both, can be treated with a suitable material so as to form a bond between the bristle sub-assembly and the brush base by means of solvent bonding, adhesive bonding, or other means known in the art.

Figure 14:
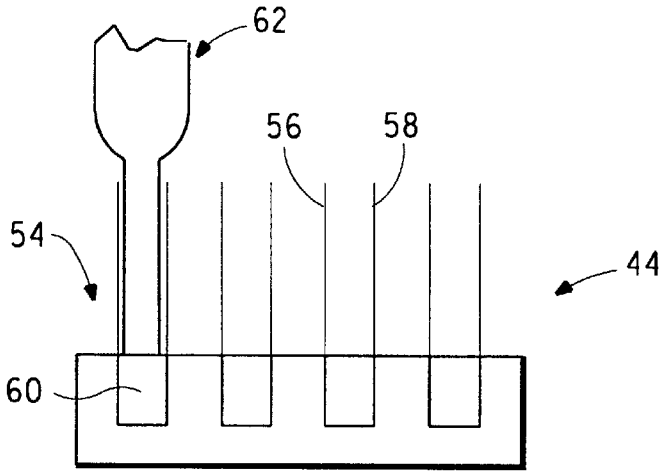

Once fitted in the grooves, an ultrasonic welding step can be employed to ensure that the bristle strings do not separate from the brush body. As seen in FIG. 14, an ultrasonic horn 62 is shaped to fit between legs 56 and 58 and make contact with the base string 60. The ultrasonic horn 62 may also be employed to insert the bristle sub-assembly 54 into groove 60 and energized by appropriate devices for further productivity improvement.

Alternatively, when the grooves are formed by using a heated male forming die, the base strings are preferably fitted in the grooves while the polymer of the brush body is still soft and floatable. The soft and floatable thermoplastic polymeric material of the brush body allows the elongated bristle sub-assembly to be received in the smaller diameter grooves and will intimately form around the irregular and non-planar surfaces. A clamping device may be used to fix a pre-selected pattern in the monofilament legs 56 and 58 as the bristle sub-assembly 54 is forced into the receiving grooves 46, 48, 50, and 52. This could be used to form unique patterns of monofilaments at the distal ends thereof. After cooling, the bristle sub-assembly is held in the groove by the frictional engagement and preferably partial melt bonding when the brush body and bristle sub-assembly are of the same or compatible thermoplastic polymeric material.

Figure 15:
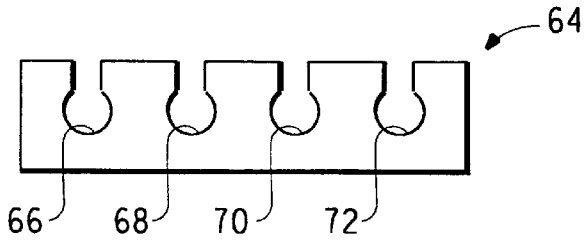
FIGS. 15–16 are sequential, schematic views showing another alternative method of making a brush incorporating a plurality of the bristle sub-assemblies of FIG. 1.
Figure 16:
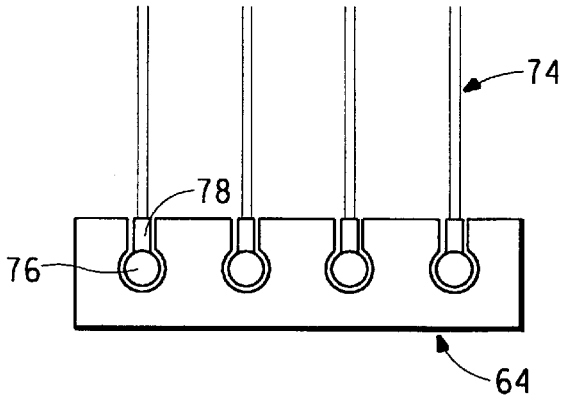

In the embodiment of FIGS. 15–16, a brush body blank 64 is molded or otherwise worked to form a plurality of key-hole shaped grooves 66, 68, 70 and 72. A plurality of bristle sub-assemblies 74 are fitted into respective grooves, preferably from the ends of the grooves rather than from the top since the open top of the grooves is more narrow than the diameter of the bristle sub-assemblies. After the bristle sub-assemblies have been seated in the grooves, the open ends of the grooves can be sealed thermally and/or with plugs or filler material 78. Alternatively, if the material of the brush body is elastomeric, it can be suitably flexed without permanently deforming the brush body 64, so as to spread open the grooves 66, 68, 70, and 72, the bristle sub-assemblies 74 may be laterally inserted through the top of the key hole, thereby obviating open ends for installation.

The key-hole slots can be formed by any conventional technique, including molding the grooves when the blank is formed or milling the grooves after the blank is formed.

Figure 17:
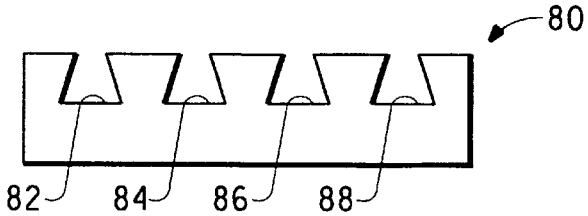
FIGS. 17–18 are sequential, schematic views showing another alternative method of making a brush incorporating a plurality of the bristle sub-assemblies of FIG. 1 as bristle cartridges.
Figure 18:
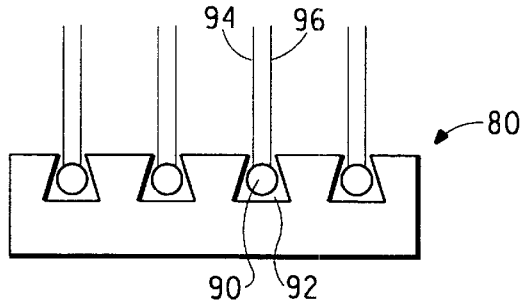
Figure 19:
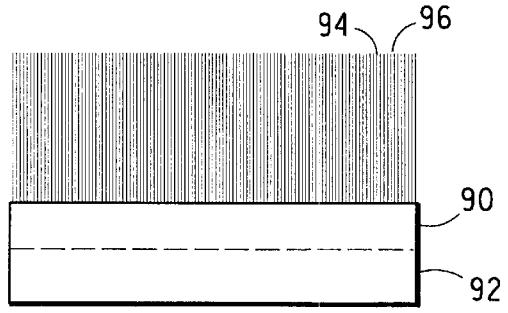
FIG. 19 is a side elevational view of a bristle cartridge used in the embodiment of FIGS. 17–18.

In the embodiment of FIGS. 17–19, the brush body blank 80 is provided with a plurality of dove-tail grooves 82, 84, 86, and 88 which can be formed pursuant to any of the known and/or previously discussed techniques. In this embodiment, the base string 90 and proximal end portions of the monofilaments of each bristle sub-assembly are separately fabricated into a dove-tail shaped strip 92 from which the legs 94 and 96 extend. The dove-tail geometry of the grooves and strips shown are but one illustrative example; other appropriate shapes could easily be adopted. The strips slide into respective grooves from the ends thereof and are held in place by ball and detent or other complementary mechanical means. In this embodiment, the bristle sub-assemblies and respective strips form cartridges that are detachable and replaceable when the bristles experience excessive wear or when other bristle properties are preferred. Alternatively, the strips or bristle sub-assemblies could be molded directly into the brush body.

Figure 21:
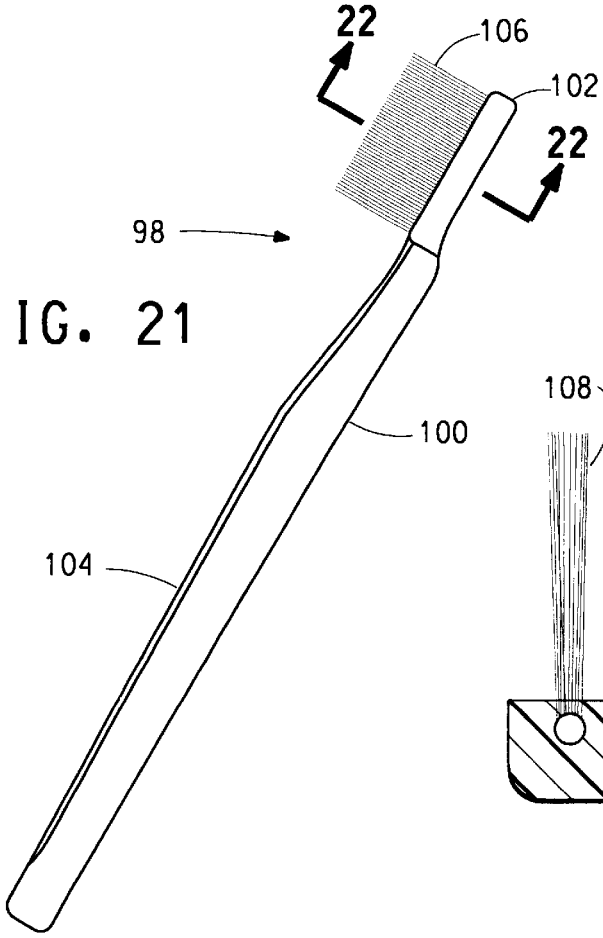
FIG. 21 is a side elevational view of a toothbrush according to one embodiment of the present invention.
Figure 22:
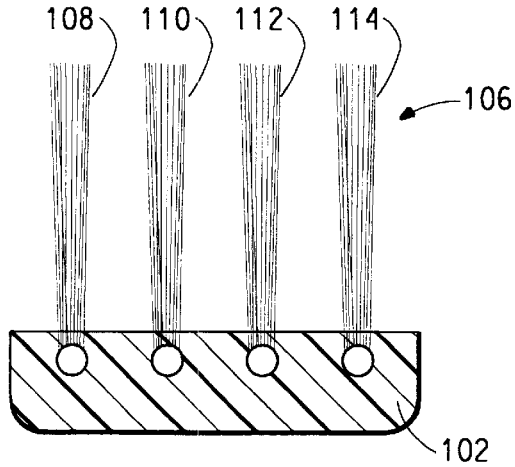
FIG. 22 is an enlarged sectional view taken along line 22—22 of FIG. 21.
Figure 23:
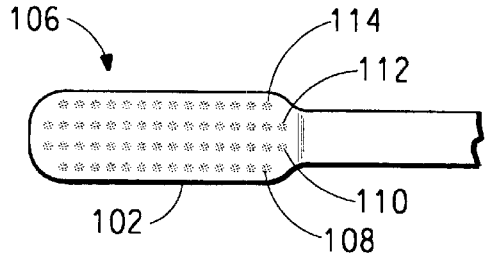
FIG. 23 is a top view of the head portion of the toothbrush of FIG. 21.

In the embodiment of FIGS. 21–23, a toothbrush 98 has a brush body 100 made of polymeric material. The body 100 includes an integrally formed head portion 102 and a handle portion 104. A bristle array 106 is connected to the head portion 102 by any appropriate means such as the techniques described above, and consists of four bristle strings 108, 110, 112, and 114, each consisting of a base string and two rows of monofilaments bent, pressed or otherwise brought together to form a single, thicker row of monofilament bristles.

In the illustrated embodiment, the bristle array 106 consists of four longitudinally oriented rows of bristles. However, the rows can be oriented in various directions and in various numbers. For example, the rows could be oriented in a lateral, transverse, or other direction. For transverse or lateral rows in the illustrated toothbrush, the rows would likely be more numerous and shorter to provide the same amount of bristles in the array.

Figure 23A:
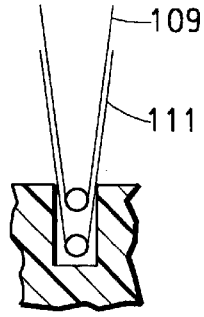
FIG. 23A is an enlarged, sectional view showing an embodiment in which two 20 bristle sub-assemblies are installed in the same groove or otherwise connected to a brush body in tandem to provide greater density and bristles of different lengths.
Figure 24:
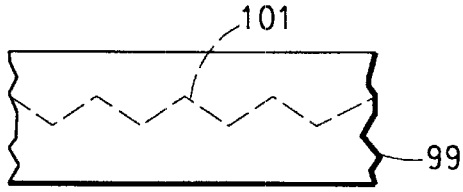
FIG. 24 is a side elevational view showing a brush body and serrated groove.
Figure 25:
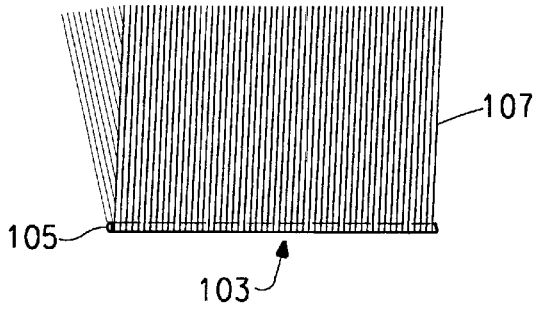
FIG. 25 is a side elevational view of a bristle sub-assembly before insertion into the serrated groove of FIG. 24.

While the illustrated embodiment shows that the length of the bristles are substantially the same, the lengths can be varied to achieve desired patterns and effects. For example, the outer bristle string monofilaments could be made longer than the adjacent, inner bristle string monofilaments. Also, the monofilaments of a particular bristle string could be cut or otherwise formed to varying lengths. As seen in FIG. 23A, two bristle sub-assemblies 109 and 111 are laterally inserted, one on top of the other, into the same groove with the result that the bristles of each will have distinctly different lengths.

Another way to vary the lengths of the bristles is shown in FIGS., 24–26. This method could be used for the toothbrush of FIGS. 21–23 or for any other brushes described herein or brushes otherwise within the scope of the present invention where varying length bristles are desired. As seen in FIGS., 24–26, a brush body 99 has a serrated groove 101 which is open at the top. The groove can be formed by molding, machining or other means. When the body 99 is made of thermoplastic material, a male die having a serrated end could be used to form the groove.

Figure 26:
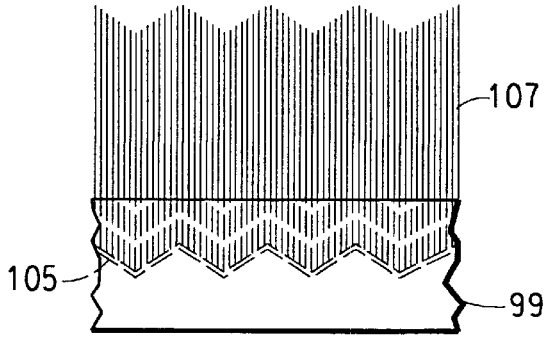
FIG. 26 is a side elevational view of the brush body of FIG. 24 assembled with the bristle sub-assembly of FIG. 25, where the upper end portions of the bristles adopt a serrated pattern due to conformity of the lower end portions to the serrated groove.

A bristle sub-assembly 103 having a base string 105 and connected monofilaments 107 is forced into the groove 101 so that the base string 105 adopts the profile of the serrations at the bottom of the groove. As the proximal end portions of the bristles 107 follow the serrations, the distal end portions mirror the, serrated pattern, as seen in FIG. 26.

Figure 27:
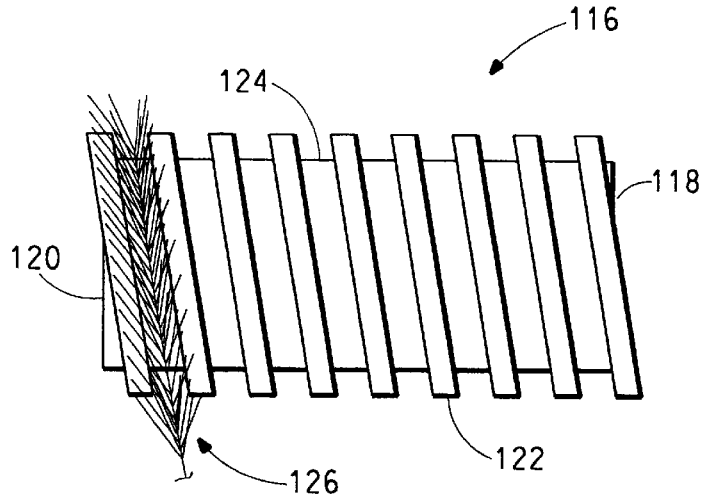
FIG. 27 is a side elevational view of a cylindrical brush according to another embodiment of the present invention, showing the sidewall of the brush body before wrapping of the bristle sub-assembly along its length.
Figure 28:
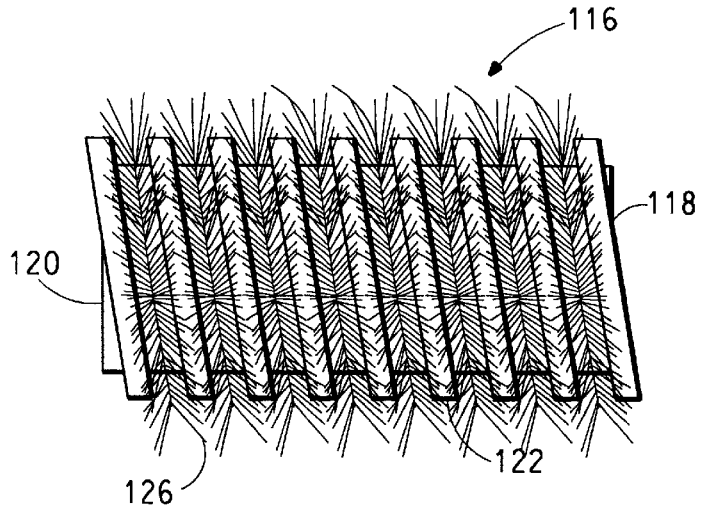
FIG. 28 is a side elevational view of the cylindrical brush of FIG. 27, with the bristle sub-assembly fully installed on the cylinder.

The brush bodies described above have planar surfaces from which the bristle arrays extend, However, the present invention is not limited to a particular shape of brush body. In the embodiment of FIGS. 27 and 28, a cylindrical brush body 116 has first and second opposite axial ends 118 and 120 and a generally cylindrical sidewall 122. A spiral groove 124 is formed in the cylindrical sidewall 122 and extends from end 118 to end 120. A single elongated bristle string 126 is wrapped around the brush body 116 and fitted into the groove 124, as shown in FIG. 28. The width and depth of the groove 124 and its bottom profile can be selected to determine the spreading of the monofilaments, a wider groove will result in a wider spread.

As long as the ends of the bristle string 126 are secured to the body 116, no means should be required between the opposite ends to hold the bristle string 126 in the groove 124. One particular advantage of the embodiment of FIGS. 27 and 28 is that the bristle string 126 can be removed and replaced with relative ease.

Rather than one continuous bristle string wrapped around the periphery of a cylinder, a plurality of bristle strings could be mounted axially to the periphery, each in their own radial plane, to cover the outer surface of the cylinder with monofilaments. To facilitate connection of the bristle strings, the outer surface of the cylinder could be provided with parallel grooves which could be formed and shaped according to the preceding embodiments. If the cylinder is made of metal, the grooves would preferably be machined according to conventional machining techniques. Another variation of the cylindrical brush would be to provide a hollow cylinder and mount the tuft strings on the interior cylindrical surface, either in a spiral or axially linear pattern.

For very long cylindrical brush bodies, where relaxation or elongation is problematic, or where cutting or abrasion of the bristle sub-assembly base string is probable, the bristle sub-assembly can be attached according to prior descriptions contained herein, by adhesive bonding, or by any suitable mechanical reinforcement, such as a wire over-wrap.

Figure 20:
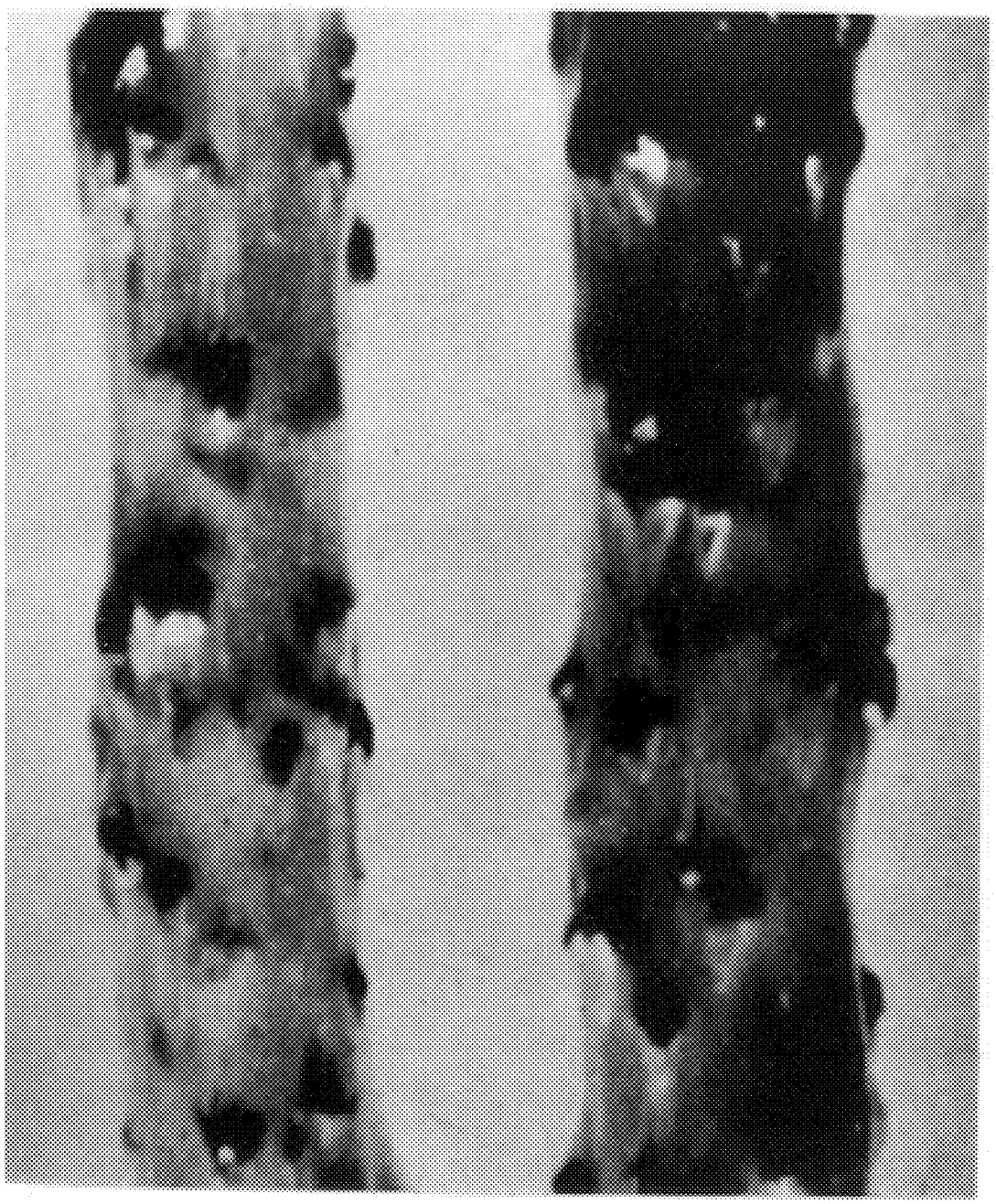
FIG. 20 is a magnified photograph of a monofilament containing grit material for abrasive applications.

For some brush applications, the monofilaments may include abrasive particles or grit material for particular brush applications. Referring to FIG. 20, two typical abrasive monofilaments are shown in magnification. The grit material is seen to protrude from the outer surface of the monofilaments. These abrasive monofilaments are commercially available under the name TYNEX® A by E.I. Du Pont De Nemours and Company of Wilmington, Del. USA. Preferably, the abrasive material comprises 0–50% by weight of the polymeric monofilaments. TYNEX® A is a 6,12 nylon monofilament containing particles of silicon carbide or aluminum oxide, which are distributed throughout the monofilament. Other particles that could be used include borites and boro-nitrides.

Figure 29:
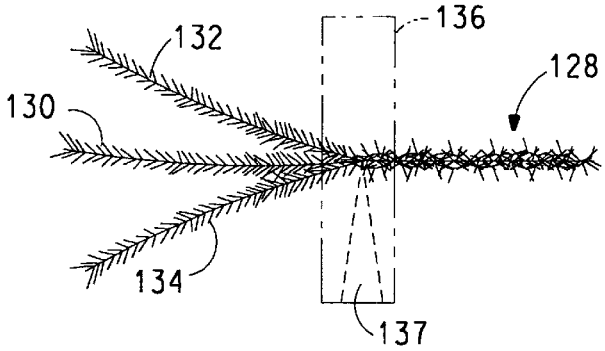
FIG. 29 is a schematic view of another embodiment of the present invention, in which three bristle sub-assemblies are twisted or braided together to form a brush.

The bristle sub-assembly described above can be used to make brushes that do not have block-type bodies or handles and do not require strands of wire to hold the monofilament bristles in place nor for structural support. Referring to FIG. 29, a cylindrical brush 128 may be formed by twisting, plying or wrapping together two or more bristle sub-assemblies, such as bristle sub-assemblies 130, 132, and 134. A twisting machine 136 of any appropriate design can be used to twist together the bristle subassemblies. Twisted bristle sub-assemblies may be bonded together by a fast setting adhesive or solvent applied by device 137 at the junction of the converging bristle subassemblies. Other fastening techniques may be employed, such as extrusion of a polymeric material, heat fusion and frictional interlocking.

The bristle sub-assemblies 130, 132, and 134 are of the same type described in the preceding embodiments, in that they each include a plurality of monofilaments connected to a base string. Also, braiding may be used as an alternative approach, rather than bonding, to interconnect the plurality of sub-assemblies.

Figure 30:
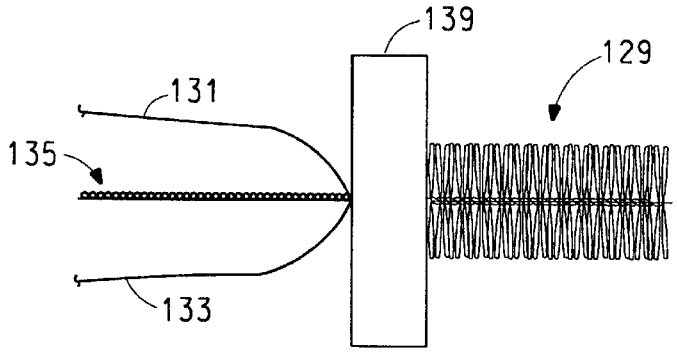
FIG. 30 is a schematic view of another embodiment of the present invention, in which a bristle sub-assembly and two wires are twisted together to form a wire brush.
Figure 31:
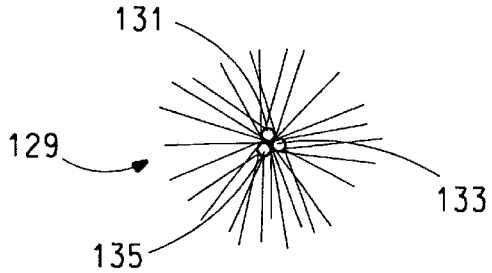
FIG. 31 is an end view of the wire brush of FIG. 30.

FIG. 30 shows a variation of the embodiment of FIG. 29, in which a wire brush 129 is made by spiral wrapping two wires 131 and 133 with a bristle sub-assembly 135 having a base string and transverse monofilaments. A twisting device 139 takes the three separate feeds and produces the spiral-wrapped wire brush 129. An end view of the brush 129 is shown in FIG. 31.

The twisted bristle sub-assemblies of FIGS. 29 and 30 are appropriate for many brushes, including, for example, cosmetic brushes, bottle brushes, mascara brushes and interdental brushes. The wireless brush sub-assemblies have particular value since there can be no metal corrosion and its by-products. Eye safety, in particular, will greatly improve with wireless mascara brushes.

Figure 32:
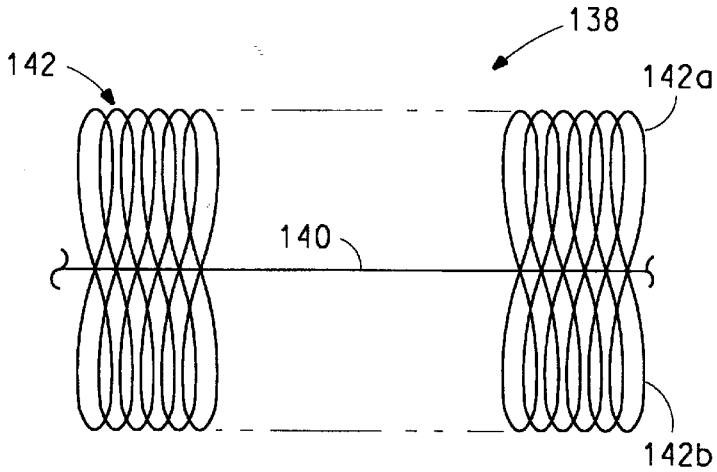
FIG. 32 is a top view of a bristle sub-assembly according to another embodiment of the present invention, in which looped monofilaments are used.
Figure 33:
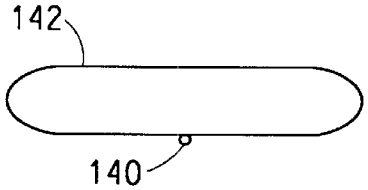
FIGS. 33 and 34 are end views showing how the loops are formed in the monofilament strand for the embodiment of FIG. 32;.
Figure 34:
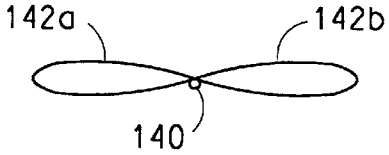

Referring to FIGS. 32–34, a bristle sub-assembly 138 includes a base string 140 and a plurality of continuously looped monofilaments 142. The looped monofilaments 142 are formed by taking a single strand of monofilament and forming a plurality of "ovals" along the length of the base string 140. Each oval is compressed to form "figure eights" and is then bonded by ultrasonic welding to the base string 140 so as to bisect the oval and create two individual loops which provide first and second legs 142A and 142B on opposite sides of the base string. The legs 142A and 142B extend outwardly and symmetrically or non-symmetrically from the base string in two rows.

One way to form the bristle sub-assembly 138 is to take a monofilament strand and wrap it around a supporting structure (not shown) to form the plurality of elongated loops 142. FIG. 33 is an end view that illustrates one of the plurality of loops. The loops 142 are then pressed at a transverse medial point into contact with the base string 140 and welded thereto by ultrasonic heating. The resulting structure, where one of the loops is transformed into two loops, is shown in FIG. 34. When ultrasonic welding is used, at least the monofilament strand 142 or the base string 140, preferably both, are made of thermoplastic polymeric materials. These have been described above in reference to other embodiments.

The looped bristle sub-assemblies can be used in many brushes, such as those described above, in place of the straight monofilament segments, or in combination therewith. For example, in the toothbrush embodiment, a mixture of looped and straight monofilaments may be used to achieve a desired effect. Also, a looped monofilament bristle string could be twisted to form a structure similar to that shown in FIG. 31.

Figure 35:
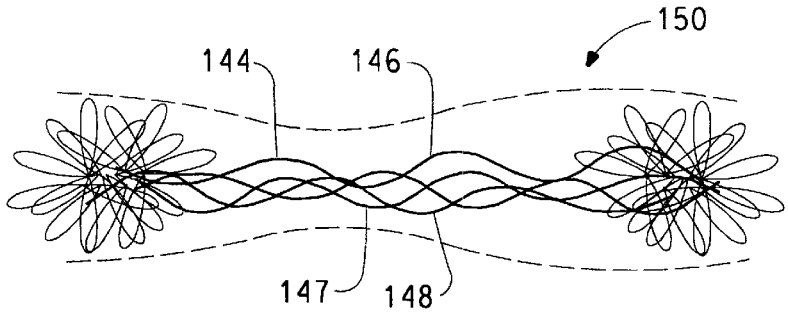
FIG. 35 is a side elevational view of a looped structure in which four of the bristle sub-assemblies of FIG. 32 are twisted or braided together.
Figure 36:
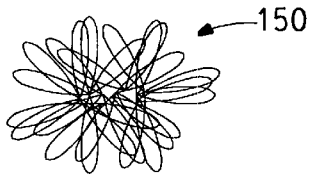
FIG. 36 is an end view of the looped structure of FIG. 35.

As seen in FIGS. 35 and 36, looped monofilament bristle strings 144, 146, 147, and 148 are twisted together to form a looped monofilament structure 150 in which the monofilament loops are plied together to provide a twist stable, three-dimensional aspect. The structure 150 can be used in brush applications, with or without a supporting body, or in other non-brush applications where a high surface area structure is desired.

In the embodiments employing a looped monofilament, it is preferable to make the length of the loop legs (such as 142A and 142B) substantially greater than the maximum width of the loop legs. It is also preferable that the monofilament strand is bonded to the base string at the point where the legs of each loop intersect the base string, so that a continuous length of looped bristle sub-assembly can be cut into segments without causing unraveling of the loops. While not preferred, the bond point may be at other locations.

The monofilaments used in any of the above embodiments may be co-extrusions of one or more polymers. Also, to achieve the desired physical characteristics of the bristles, it has been found that the preferred monofilaments are those having a diameter between 2 and 200 mils, and preferably between 2 and 20 mils. In a particularly preferred embodiment for the toothbrush, the monofilaments are 6–10 mils in diameter. Monofilaments of different diameters, polymer composition where compatible, and/or colors can be combined in one bristle assembly or sub-assembly to achieve specific brushing characteristics and/or appearance.

In embodiments using nylon for either the monofilament, or the base string, or both, a preferred nylon filament is sold under the name TYNEX®, and is manufactured by E.I. Du Pont De Nemours and Company of Wilmington, Del. USA. TYNEX® is a 6,12 nylon filament made of polyhexamethylene dodecanamide. It has a melting point of between 208 and 215 C and has a specific gravity of 1.05–1.07, and is available commercially in many cross-sectional shapes and diameters.

Monofilaments and/or base strings suitable for use in the present invention can have shapes other than circular cross-sections, and may be hollow or have voids in cross-section. Embodiments described above show circular cross-sectional shapes for the base string and monofilaments. In one embodiment, the base string had a rectangular cross-sectional shape. Either or both the base string and monofilaments could have oval or other shapes. In any shape, the preferred thicknesses for the base string and monofilaments are selected to provide a level of functionality to the individual brush applications. With respect to the base string, the preferred embodiments described above single strand of monofilament material. However, the base string could be a bundle of monofilaments having at least one of the monofilaments made of polymeric thermoplastic material.

The polymeric monofilaments used for bristles in the various embodiments described above can have other additives. For example, the polymeric monofilaments could include 0–50% by weight particles having functional and/or aesthetic quality. One example would be particulate material that provides a color feature that would enhance the visual appearance of the bristles. Other functional particles could also be included such as anti-microbial additives in the polymeric monofilaments. Other particulate materials or coatings may be applied to or embodied within the monofilament such as therapeutic agents or colorants, or other desirable additives. Also, the monofilaments may be surface treated to provide desired properties, such as to alter the frictional coefficient.

The embodiments described above require "connection" between the monofilaments and the base string. In this context, "connection" means that the monofilaments are attached to the base string by a frangible joint formed by melting, adhesive bonding, solvent bonding, or similar means. The degree of frangibility can be controlled so that, if desired, the base string can be easily separated from the monofilaments after bonding.

Figure 37:
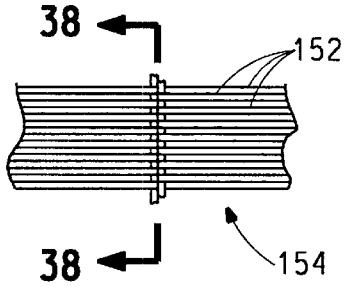
FIG. 37 is a partial top view of a bristle sub-assembly according to another embodiment of the present invention.
Figure 38:
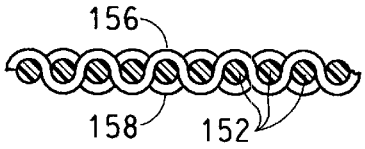
FIG. 38 is a vertical cross-sectional view taken along line 38—38 of FIG. 37.

In an alternative embodiment, shown in FIGS. 37 and 38, a plurality of monofilaments 152 are disposed in a substantially linear, parallel array 154. Rather than bond-connecting, the monofilaments 152 are interlocked by weaving or stitching at least two base strings 156 and 158. The resulting bristle sub-assembly would have two relatively flat rows of monofilament segments disposed on opposite sides of the base strings, and could be used in various brush bodies including those described above. In the woven or stitched embodiment, it is not as important for the monofilaments and the base strings to be thermoplastic or polymeric since heat fusion is not needed. Indeed, non-polymeric materials can be used, including ceramic filaments, glass filaments, and metal wire filaments.

Figure 39:
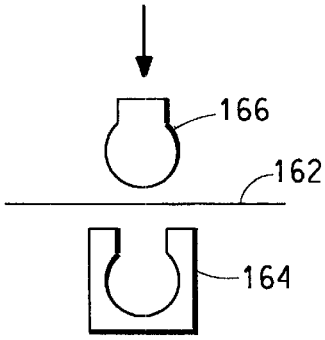
FIG. 39 is an exploded, end view of a bristle sub-assembly according to embodiment of the present invention.
Figure 40:
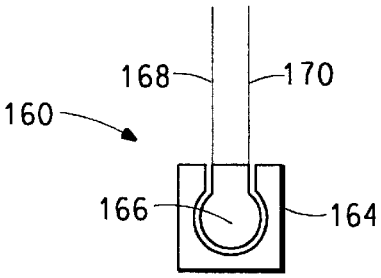
FIG. 40 is an end view of the bristle sub-assembly of FIG. 39.

Another embodiment that does not require connection between the monofilaments and the base string is shown in FIGS. 39 and 40. There, a bristle sub-assembly 160 includes a plurality of monofilaments 162 that are captured between a lower base string 164 and an upper base string 166. A force is applied in the direction of the arrow to push the upper base string 166 and plurality of monofilaments 162 into a groove formed in the lower base string 164. The fit clearance between strings 164 and 166 are predetermined and selected for the diameter of monofilament 162 to be captured by the interlocking of strings 164 and 166 as the monofilaments 162 are gap filling. Any appropriate shape of the groove can be provided to ensure mechanical interlocking of the two strings. This mechanical interlock is achieved by using polymeric materials that are resilient to permit passage of the upper string into the groove of the lower string, After the two strings are interfitted, the monofilaments will bend upward to form two rows of legs 168 and 170 as in the other embodiments. The two base strings are disposed respectively below and above the monofilaments and in alignment with each other and thus interlock with each other to capture the monofilaments therebetween.

The embodiments of FIGS. 37–40 preferably use the materials described in the previous embodiments, along with additional non-thermoplastic and non-polymeric materials that may be used in the absence of heat, adhesive, or solvent fusion.

In the various embodiments described herein, the non-looped monofilaments have been described as linear and parallel. It is possible to use polymeric monofilaments that are non-linear, however, such as in the case of monofilaments that have been crimped wavy or otherwise conditioned to a predisposed non-linear formation.

Although the invention has been described with reference to several particular embodiments, it will be understood to those skilled in the art that the invention is capable of a variety of alternative embodiments within the spirit and scope of the appended claims.

What is claimed is:

1. A bristle sub-assembly comprising a base string, and a plurality of monofilaments connected to the base string by a frangible joint, wherein the monofilaments are adhesively bonded to the base string.

2. A bristle sub-assembly comprising a base string, and a plurality of monofilaments connected to the base string by a frangible joint, wherein the monofilaments are solvent bonded to the base string.

3. A brush assembly comprising a brush body, and at least one bristle sub-assembly connected to the brush body, and including a base string and a plurality of monofilaments connected to the base string by a frangible joint, wherein the monofilaments are adhesively bonded to the base string.

4. A brush assembly comprising a brush body, and at least one bristle sub-assembly connected to the brush body, and including a base string and a plurality of monofilaments connected to the base string by a frangible joint, wherein the monofilaments are solvent bonded to the base string.

5. A wire brush comprising:

a bristle sub-assembly which includes a base string and a plurality of monofilaments connected to the base string; and a first wire twisted together with the first bristle sub-assembly.

6. A wire brush according to claim 5, further comprising a second wire twisted together with the first wire and the bristle sub-assembly.

7. A wire brush according to claim 5, wherein the plurality of monofilaments are made of material selected from the group consisting of aliphatic polyamides, aromatic polyamides, polyesters, polyolefins, styrenes, polyvinylchloride (PVC), polyurethane, fluoropolymers, polyvinylidene chloride, and polystyrene and styrene copolymers.

8. A wire brush according to claim 5, wherein the plurality of monofilaments are made of a nylon material.

9. A wire brush according to claim 8, wherein the nylon material is selected from the group consisting of 4 nylon, 6 nylon, 11 nylon, 12 nylon, 6,6 nylon, 6,10 nylon, 6,14 nylon, 10,10 nylon and 12,12 nylon and other nylon co-polymers.

* * * * *